US010806983B1

(12) United States Patent
Hawkins

(10) Patent No.: US 10,806,983 B1
(45) Date of Patent: Oct. 20, 2020

(54) SWING MECHANICS SHOULDER HARNESS AND BARREL AX

(71) Applicant: Craig Steven Hawkins, Kennesaw, GA (US)

(72) Inventor: Craig Steven Hawkins, Kennesaw, GA (US)

( * ) Notice: Subject to any disclaimer, the term of this patent is extended or adjusted under 35 U.S.C. 154(b) by 0 days.

(21) Appl. No.: 16/567,425

(22) Filed: Sep. 11, 2019

Related U.S. Application Data

(60) Provisional application No. 62/849,982, filed on May 20, 2019, provisional application No. 62/886,959, filed on Aug. 14, 2019.

(51) Int. Cl.

| | |
|---|---|
| ***A63B 69/00*** | (2006.01) |
| *A63B 102/20* | (2015.01) |
| *A63B 69/38* | (2006.01) |
| *A63B 59/50* | (2015.01) |
| *A63B 69/36* | (2006.01) |
| *A63B 102/18* | (2015.01) |

(52) U.S. Cl.
CPC ..... *A63B 69/0059* (2013.01); *A63B 69/0002* (2013.01); *A63B 59/50* (2015.10); *A63B 69/3644* (2013.01); *A63B 69/38* (2013.01); *A63B 2069/0008* (2013.01); *A63B 2102/18* (2015.10); *A63B 2102/20* (2015.10); *A63B 2209/08* (2013.01); *A63B 2209/10* (2013.01)

(58) Field of Classification Search
CPC ..... A63B 69/0002; A63B 2069/0008; A63B 60/12; A63B 59/50; A63B 2102/18; A63B 2209/00; A63B 69/0059; A63B 69/3644; A63B 69/38; A63B 2102/20; A63B 2209/08; A63B 2209/10
USPC ..... 473/422, 458, 450, 464, 453, 276, 275, 473/212–214, 457
See application file for complete search history.

(56) References Cited

U.S. PATENT DOCUMENTS

| | | | | | |
|---|---|---|---|---|---|
| 3,101,196 | A | * | 8/1963 | Ferrara | A63D 5/00 473/63 |
| 3,419,277 | A | * | 12/1968 | Martin | A63B 69/0059 473/214 |
| 3,595,583 | A | * | 7/1971 | Oppenheimer | A63B 69/0059 473/215 |
| 3,937,465 | A | * | 2/1976 | Roland | A63B 69/38 473/461 |
| 4,030,732 | A | * | 6/1977 | Vincent | A63B 21/0004 473/464 |
| 4,746,118 | A | * | 5/1988 | Deveney | A63B 69/0002 473/208 |
| 4,984,789 | A | * | 1/1991 | Socci | A63B 69/0002 473/458 |
| 5,154,416 | A | * | 10/1992 | Smull | A63B 69/0059 473/458 |

(Continued)

OTHER PUBLICATIONS

International Search Report and Written Opinion dated Dec. 6, 2019 for PCT Patent Application No. PCT/US19/52153.

*Primary Examiner* — Mitra Aryanpour

(57) ABSTRACT

Various embodiments for a swing mechanics shoulder harness and barrel ax are described. The swing mechanics shoulder harness and barrel ax may be used to train an operator the proper biomechanical sequence of a swing. The swing mechanics shoulder harness and barrel ax includes a shoulder harness, a shoulder portion, a chest portion, a first coupling section, a second coupling section, and at least one wrist attachment.

10 Claims, 12 Drawing Sheets

(56) References Cited

U.S. PATENT DOCUMENTS

| | | | | |
|---|---|---|---|---|
| 5,704,856 | A | 1/1998 | Morse | |
| 5,865,685 | A | 2/1999 | Thomas | |
| 5,907,819 | A | 5/1999 | Johnson | |
| 6,599,201 | B1 | 7/2003 | Grant | |
| 6,773,366 | B2 | 8/2004 | Gray | |
| 7,128,658 | B2 * | 10/2006 | DuFour | A63B 69/0059 473/276 |
| 7,214,139 | B2 * | 5/2007 | Parris | A63B 69/3608 473/207 |
| 8,231,484 | B1 | 7/2012 | Quinn | |
| 8,852,015 | B1 * | 10/2014 | Hoang | A63B 69/3608 473/212 |
| 9,242,159 | B1 | 1/2016 | Lacoste et al. | |
| 9,295,868 | B2 * | 3/2016 | Beroza | A63B 21/0442 473/446 |
| 9,440,131 | B2 | 9/2016 | Mueller | |
| 9,592,435 | B1 * | 3/2017 | Faucette | A63B 69/3608 473/206 |
| 9,700,775 | B2 * | 7/2017 | Hamilton | A63B 69/0002 473/458 |
| 10,456,646 | B2 * | 10/2019 | English | A63B 69/0002 473/458 |
| 2002/0039930 | A1 * | 4/2002 | Smith | A63B 69/0059 473/215 |
| 2004/0235581 | A1 | 11/2004 | Citron et al. | |
| 2009/0098945 | A1 * | 4/2009 | George | A63B 21/0552 473/213 |
| 2009/0197692 | A1 | 8/2009 | Eck | |
| 2013/0324331 | A1 * | 12/2013 | Barnhill | A63B 69/0002 473/458 |
| 2015/0165293 | A1 * | 6/2015 | Hamilton | A63B 69/0002 473/453 |

* cited by examiner

SWING MECHANICS SHOULDER HARNESS AND BARREL AX

CROSS-REFERENCE TO RELATED APPLICATIONS

This application claims the benefit of and priority to U.S. Provisional Patent Application No. 62/849,982 entitled "MAGNETIC SHOULDER HARNESS WITH BARREL AX," filed May 20, 2019, and further claims the benefit of and priority to U.S. Provisional Patent Application No. 62/886,959 entitled "VELCRO HITTER FOR BASEBALL AND SOFTBALL," filed Aug. 14, 2019, the contents of which being incorporated by reference in their entireties herein.

BACKGROUND

Swing training aids are beneficial in training an operator the proper biomechanics of swinging a swinging device such as a baseball bat, a golf club, or other sports apparatus. Notably, a swing, such as a baseball swing, can be separated into six distinct stages, such as the stance; stride; coiling; swing initiation; swing acceleration; and follow-through. Swing training aids help teach an operator the correct biomechanical movements for swinging the swinging device through a particular stage of the swing or, alternatively, through multiple stages of the swing. Correspondingly, training an operator on how to master the most efficient and effective biomechanical sequence of movements when swinging a swinging device may be difficult without repeatable reinforcement of an ideal biomechanical movement.

BRIEF SUMMARY OF INVENTION

A swing training device is provided, that includes a shoulder harness. The shoulder harness may include a shoulder portion configured to be worn about a shoulder of an operator, a chest portion configured to be worn about a chest of the operator, at least one wrist attachment configured to be worn on a wrist of the operator, and at least one coupling member. The at least one coupling member may include a first end and a second end. The first end of the at least one coupling member can be configured to be secured to the at least one wrist attachment and the second end of the at least one coupling member configured to detachably attach to one of: the shoulder portion or the chest portion. The at least one coupling member is configured to maintain a chest-to-arm position of the operator and detach from one of the shoulder portion or the chest portion in response to a predefined amount of force being exerted by the operator during a swing motion.

In some embodiments, the at least one wrist attachment includes a first wrist attachment to be worn on a first wrist of the operator and a second wrist attachment to be worn on the second wrist of the operator, where the at least one coupling member is a first coupling member and a second coupling member, a first end of the first coupling member is configured to be secured to the first wrist attachment, and a second end of the first coupling member is configured to removably attach to the shoulder portion, a first end of the second coupling member is configured to be secured to the second wrist attachment, and a second end of the second coupling member is configured to removably attach to the chest portion.

In some embodiments, the second end of the first coupling member can include a first magnet configured to magnetically couple to the shoulder portion; and the second end of the second coupling member comprises a second magnet configured to magnetically couple to the chest portion. Alternatively, in some embodiments, the second end of the first coupling member comprises a first plurality of hook-and-loop fasteners (e.g., VELCRO) that are configured to couple to the shoulder portion; and the second end of the second coupling member comprises a second plurality of hook-and-loop fasteners (e.g., VELCRO) configured to couple to the chest portion.

Further, in some embodiments, the coupling member includes a noise emitting device configured to emit a noise when the at least one coupling member decouples from the shoulder portion or the chest portion. For instance, in embodiments in which the hook-and-loop fasteners are employed, the fasteners create a noise as they are separated. Also, the shoulder portion can include a first padded member configured to be positioned on the shoulder of the operator; and the chest portion can include a second padded member configured to be worn on the chest of the operator. The at least one coupling member can be at least one cylindrical rod in some embodiments.

In further embodiments, the swing training device includes a collar configured to detachably attach to a shaft of a swinging device, the collar comprising a first portion detachably attached to a second portion, the collar further comprising an elongated substantially horizontal surface projecting from at least one of the first portion and the second portion, the elongated substantially horizontal surface being adapted to contact a ball. For instance, the cylindrical collar can be configured to secure to a shaft of a baseball bat or a golf club.

Various embodiments are also provided for a method of perfecting swing mechanics that includes providing the swing training device described above, positioning the swing training device on the operator; and performing, by the operator, a swing using the swing training device.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

Figure 1:
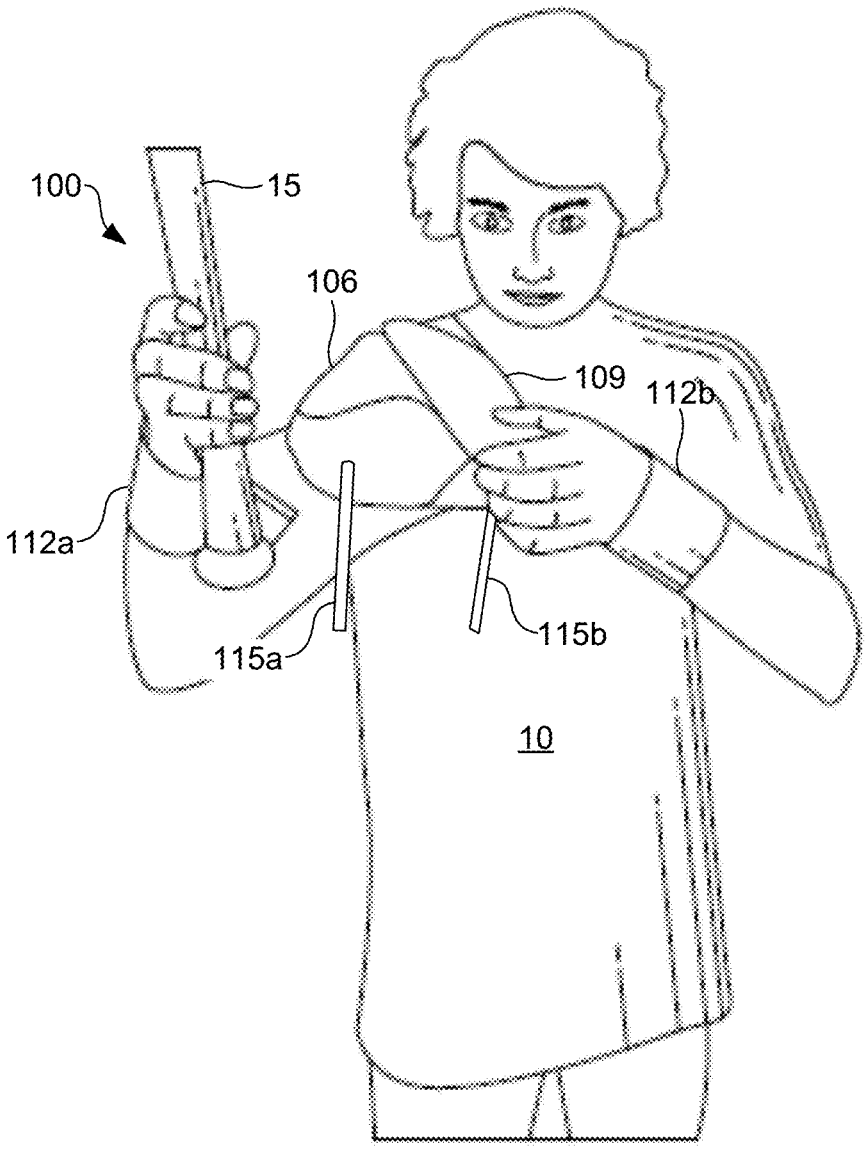
FIG. 1 is a perspective view of a shoulder harness of a swing training aid worn on an operator according to various embodiments of the present disclosure.

The present disclosure relates to a swing mechanics shoulder harness and barrel ax that can be used to train an operator, such as an athlete, the proper biomechanics of a swing. As noted above, obtaining efficient swing mechanics is difficult to develop in both young and advanced athletes alike. To that end, swing training aids are beneficial tools to help teach the proper biomechanics of a swing. Swing training aids promote muscle-memory and reinforce the correct swing sequencing and timing to promote the efficient delivery of the maximum amount of force to an object ball.

Various embodiments are described herein for a shoulder harness that can be used to train proper biomechanics of a swing. The shoulder harness and/or barrel ax provides an alternative to currently available swing training aids, for instance, as the shoulder harness is easier to couple wrist portions to the harness while simultaneously holding a swinging device, as opposed to currently available products that requires an operator to loop connectors to various attachment components that are located on either the swinging device or other parts of the operator. Also, the currently available products may prematurely interrupt the swing sequence because it is easy for the connectors to slip off and become detached from the various attachment components, thereby, interrupting the operator and requiring the operator to reset their swing by resetting the swing training aid. Moreover, currently available products also physically prevent the operator from completing all six stages of a swing due to the harness or the connectors physically impeding completion of the swing.

In the context outlined above, the embodiments described herein are directed to a shoulder harness and/or a barrel ax for training an operator a preferred biomechanical swing movement to efficiently deliver the maximum amount of force to an object, such as a baseball, a golf ball, etc. The shoulder harness and/or the barrel ax provide an alternative swing training aid because, in some embodiments, the shoulder harness utilizes magnetic couplers or hook-and-loop fasteners that couple to a harness worn by an operator. When a predetermined force is exerted at a predetermined stage of a swing, the couplers are configured to decouple from at least a portion of the harness, or decoupling entirely, allowing the operator to accelerate from the stance through the other stages of the swing sequence. All six stages of the swing can be accomplished.

Furthermore, the barrel ax portion is configured to provide visual feedback to the operator of when the operator is making square contact with an object relative to the swinging device. In various embodiments of the present disclosure, the strength of the coupling force may be adjusted by a plurality of coupling means, which may include a magnet in some embodiments, adding layers of padding to the padded member that covers the coupling section, or by adjusting the length of the coupling member on the wrist attachment. In various embodiments of the present disclosure, the coupling means of the wrist attachment is a hook and loop strap that may connect to either the shoulder portion or the chest portion of the shoulder harness.

Accordingly, a swing training device is provided that includes a shoulder harness. The shoulder harness may include a shoulder portion configured to be worn about a shoulder of an operator, a chest portion configured to be worn about a chest of the operator, at least one wrist attachment configured to be worn on a wrist of the operator, and at least one coupling member. The at least one coupling member may include a first end and a second end. The first end of the at least one coupling member can be configured to be secured to the at least one wrist attachment and the second end of the at least one coupling member configured to detachably attach to one of: the shoulder portion or the chest portion. The at least one coupling member is configured to maintain a chest-to-arm position of the operator and detach from one of the shoulder portion or the chest portion in response to a predefined amount of force being exerted by the operator during a swing motion.

In some embodiments, the at least one wrist attachment includes a first wrist attachment to be worn on a first wrist of the operator and a second wrist attachment to be worn on the second wrist of the operator, where the at least one coupling member is a first coupling member and a second coupling member, a first end of the first coupling member is configured to be secured to the first wrist attachment, and a second end of the first coupling member is configured to removably attach to the shoulder portion, a first end of the second coupling member is configured to be secured to the second wrist attachment, and a second end of the second coupling member is configured to removably attach to the chest portion.

In some embodiments, the second end of the first coupling member can include a first magnet configured to magnetically couple to the shoulder portion; and the second end of the second coupling member comprises a second magnet configured to magnetically couple to the chest portion. Alternatively, in some embodiments, the second end of the first coupling member comprises a first plurality of hook-and-loop fasteners (e.g., VELCRO) that are configured to couple to the shoulder portion; and the second end of the second coupling member comprises a second plurality of hook-and-loop fasteners (e.g., VELCRO) configured to couple to the chest portion.

Further, in some embodiments, the coupling member includes a noise emitting device configured to emit a noise when the at least one coupling member decouples from the shoulder portion or the chest portion. Also, the shoulder portion can include a first padded member configured to be positioned on the shoulder of the operator; and the chest portion can include a second padded member configured to be worn on the chest of the operator. The at least one coupling member can be at least one cylindrical rod in some embodiments.

In further embodiments, the swing training device includes a collar configured to detechably attach to a shaft of a swinging device, the collar comprising a first portion detachably attached to a second portion, the collar further comprising an elongated substantially horizontal surface projecting from at least one of the first portion and the second portion, the elongated substantially horizontal surface being adapted to contact a ball. For instance, the cylindrical collar can be configured to secure to a shaft of a baseball bat or a golf club.

Turning now to the drawings, FIG. 1 illustrates an example of an operator 10 wearing a shoulder harness 100 according to various embodiments. The operator 10 is shown holding a swinging device 15, which can include a baseball bat, a golf club, a cricket bat, or other swinging device as can be appreciated. While many embodiments are described herein with reference to baseball, the invention is not so limited unless limited by the appended claims. The relative sizes of various components of the shoulder harness 100, as shown in the figures, are not intended to be limiting, as the individual components of the shoulder harness 100 can vary in size and/or proportions as compared to each other in various embodiments, as will be appreciated.

In various embodiments, the shoulder harness 100 includes a shoulder portion 106, a chest portion 109, one or more wrist attachments 112*a*, 112*b* (collectively "wrist attachments 112"), and one or more coupling members 115*a*, 115*b* (collectively "coupling members 115"). The shoulder portion 106 is configured to be worn about a shoulder of the operator 10. Similarly, the chest portion 109 is configured to be worn about a chest of the operator. The wrist attachments 112 are configured to be worn on wrists of the operator 10. For instance, in embodiments in which only a single wrist attachment 112 is employed, the wrist attachment may be secured to one of the left wrist or the right wrist of the operator 10. Alternatively, in embodiments in which two wrist attachments 112 are employed, a first wrist attachment 112*a* may be secured to the left wrist of the operator 10 and the second wrist attachment 112*b* may be secured to the right wrist of the operator 10, or vice versa.

The coupling members 115 can be configured to detachably attach to the wrist attachments 112 and/or can be configured to detachably attach to one of the shoulder portion 106 or the chest portion 109. For instance, in embodiments in which two coupling members 115 are employed, a first coupling member 115*a* can be configured to couple a first wrist portion 112*a* to the shoulder portion 106 of the shoulder harness 100, and a second coupling member 115*b* can be configured to couple the second wrist portion 112*b* to the chest portion 106, or vice versa, while the operator 10 is in an initial phase of a swing (e.g., when the operator 10 is in the stance position). However, the coupling members 115 are sized and positioned to detach from one or more of the components of the shoulder harness 100, for instance, in response to a predetermined amount of force being exerted during a swing or, in other words, in response to a predetermined stage of a swing being reached.

More specifically, the coupling members 115 are sized and positioned to maintain a chest-to-arm position of the operator 10 during a stance or other preliminary phase of a swing. However, the coupling members 115 are configured to detach from one of the shoulder portion 106 or the chest portion 109, for instance, in response to a predefined amount of force being exerted by the operator during a swing motion. In some embodiments, the coupling members 115 are configured detach from the wrist portions 112 instead of the shoulder portion 106 or the chest portion 109. In further embodiments, the coupling members 115 are configured detach from all of the wrist portions 112, the shoulder portion 106, and the chest portion 109. In these embodiments, the coupling members 115 can simply fall to the ground during the swing.

Figure 2:
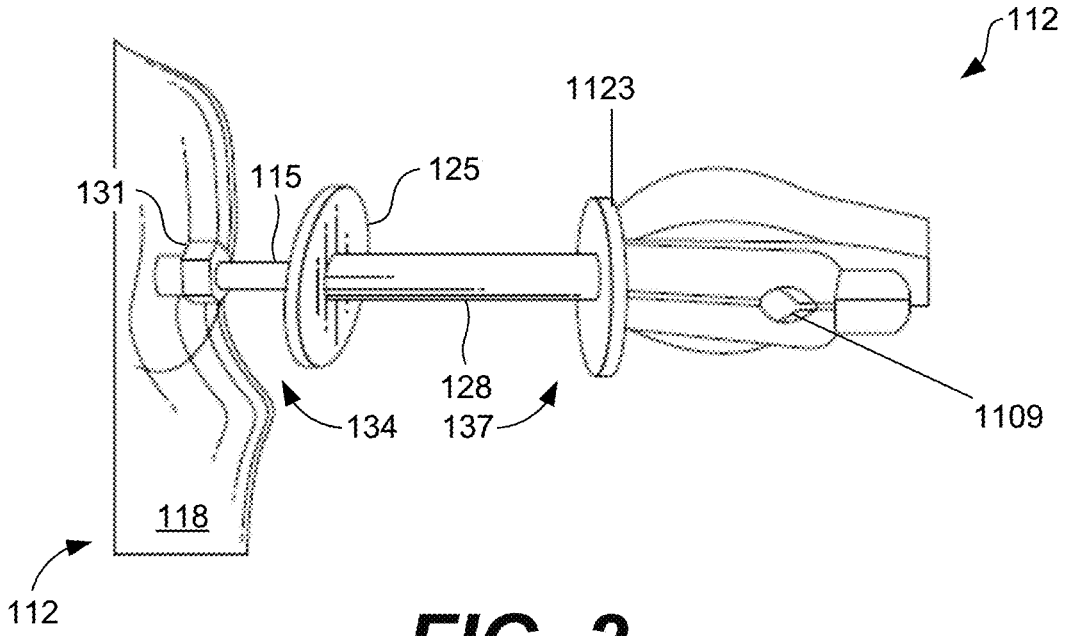
FIG. 2 is an enhanced view of the shoulder harness illustrating a coupling member according to various embodiments of the present disclosure.

Referring next to FIG. 2, an enhanced perspective view of a wrist attachment 112 and a coupling member 115 are shown. The wrist attachment 112 can include a wrist strap 118, where the coupling members 115 extend between the wrist strap 118 and a shoulder portion 106 or chest portion 109. In some embodiments, the coupling member 115 is secured to the wrist attachments 112, the shoulder portion 106, and/or the chest portion 109 using one or more magnets 125, a plurality of hook-and-loop fasteners (e.g., VELCRO), or other suitable coupling mechanism.

The shoulder harness 100 can include a magnet 125 positioned on or near the coupling member 115. As can be appreciated, the magnet 125 creates a detachable connection with another component of the shoulder harness 100, such as the wrist attachment 112, shoulder portion 106, and/or chest portion 109. To this end, the coupling member 115 can detachably attach to other components of the shoulder harness 100 made of or comprising a magnetic material, such as the shoulder portion 106, the chest portion 109, or a magnet positioned in the wrist strap 118.

In some embodiments, the magnet 125 can include a circular magnet, or other suitable shape. Further, the magnet 125 can include an aperture in which the coupling member 115 is positioned such that the magnet 125 is capable of moving along a body of the coupling member 115. A rod 128, having a diameter greater than that of the coupling member 115, can prohibit movement of the magnet 125 beyond a predetermined distance. To this end, in some embodiments, the distance (and strength) of the magnet 125 from the shoulder portion 106 and/or chest portion 109 is adjustable by the operator 10. In other words, the force between the coupling member 115 and the wrist attachment 112 (or the coupling member 115 and the shoulder portion 106 or chest portion 109) is adjustable and variable.

The wrist strap 118 may include a band of material configured to be placed on the wrist of the operator 10, such as nylon, polyester, cotton, or other suitable fabric. In various embodiments, the wrist strap 118 may be made of any of a plurality of stretchable materials suitable for securing around the wrist of an operator including terrycloth fabric, moisture wicking fabric, corded fabric, plastic, silicon, other materials, and/or combinations thereof. The wrist strap 118 may be secured around the wrist of an operator by any of a plurality of connection mechanisms, such as a hook-and-loop strap, snap fasteners, elastic materials, side release buckles, other connectors, or a combination thereof.

In some embodiments, the rod 115 can include a cylindrical, longitudinally-extending member having a female threaded screw body therein. The coupling member can include a male threaded screw body that engaged with the female threaded screw body of the rod 115. A screw head 131 may retain the coupling member 115 to the wrist attachment 118 or other component in some embodiments (e.g., in embodiments in which the coupling member 115 is not detachably attachable to the wrist attachment 118).

In various embodiments, the wrist strap 118 may also include a piece of padded material positioned over the screw head 131 when the screw head 131 is positioned in the wrist strap 118. The padded material aids in securing the screw head to the wrist strap 118 and to protect the wrist of the operator.

The coupling members 115 may include a first end 134 and a second end 137. The first end 134 of the coupling member 115 can be configured to be secured to the wrist attachment 112 and the second end 137 of the coupling member 115 can be configured to detachably attach to one of the shoulder portion 106 or the chest portion 109. The coupling member 115, when coupled between the wrist attachment 112 and one of the shoulder portion 106 and the chest portion 109, is configured to maintain a chest-to-arm position of the operator 10 and detach from one of the shoulder portion 106 or the chest portion 109 in response to a predefined amount of force being exerted by the operator 10 during a swing motion.

Figure 3:
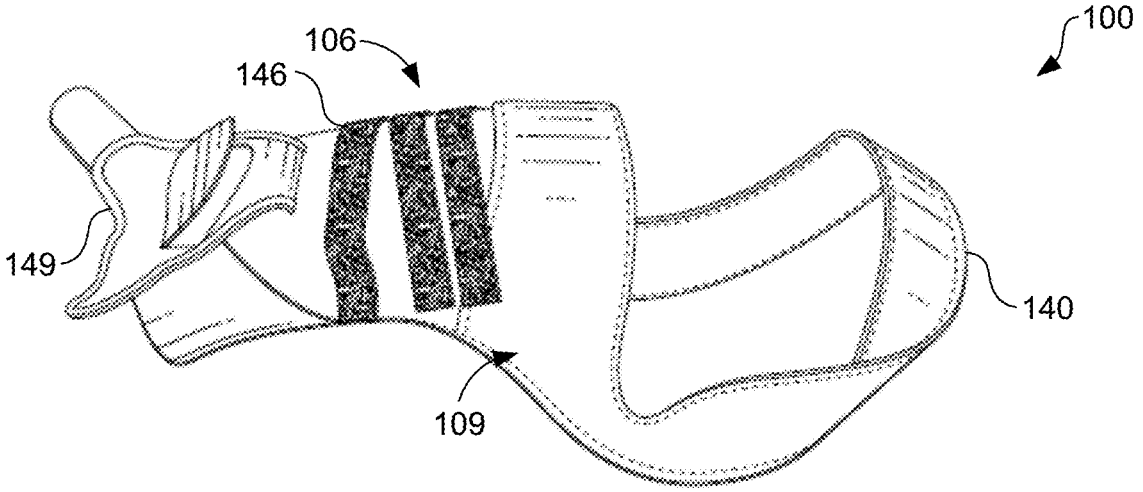
FIGS. 3-8 are various perspective views of the shoulder harness according to various embodiments of the present disclosure.
Figure 4:
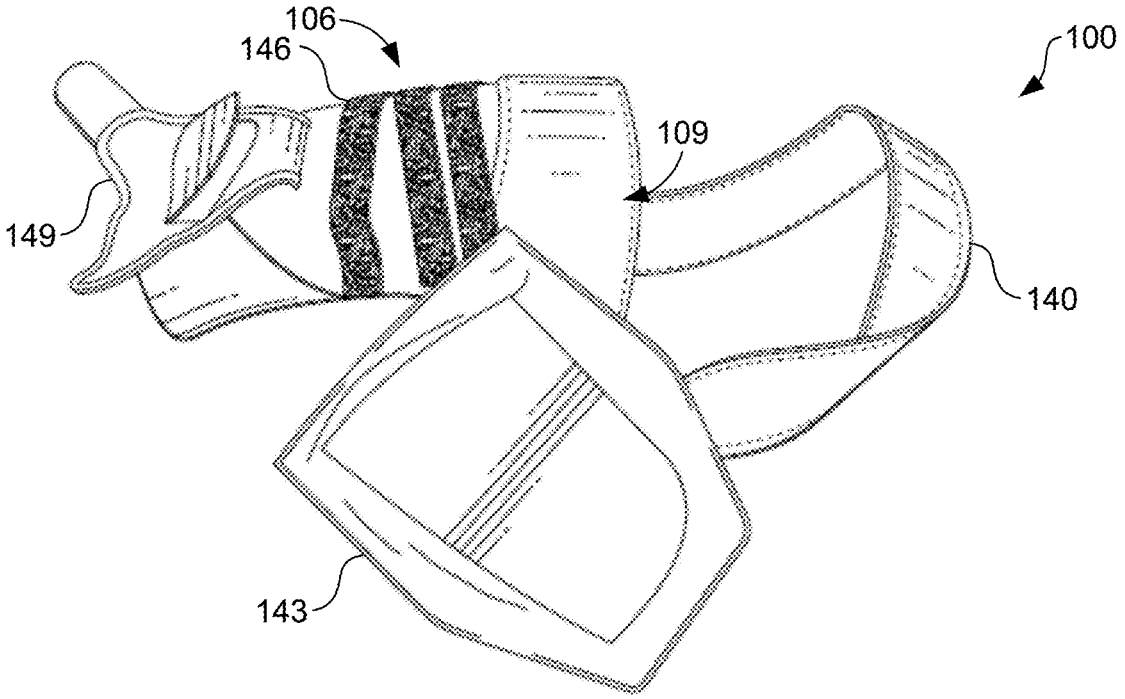

Turning now to FIGS. 3 and 4 collectively, perspective views of the shoulder harness 100 are shown, with the coupling member 115 removed for explanatory purposes.

The shoulder portion 106 of the shoulder harness 100 may be positioned on either the right or left shoulder of an operator 10, as may be appreciated. The shoulder harness 100 further includes a chest strap 140 that is configured to be positioned across the chest of the operator 10, for instance, under the arm opposite the shoulder on which the shoulder harness 100 is placed, and around the back of the operator to connect to the shoulder harness 100. A connection mechanism of the chest strap 140 may be made of any of a plurality of materials suitable for connecting to the shoulder harness 100 including, but not limited to, hook and loop connectors, snap fasteners, side release buckles, button and buttonholes, sewed connections, other connection devices, and/or combinations thereof.

In embodiments in which a magnet 125 is used to magnetically couple the coupling member 115 between a wrist attachment 112 and the shoulder portion 106, the shoulder portion 106 can include a magnetic plate 143 that, in some examples, can be removably coupled to the shoulder harness 100. As such, the shoulder portion 106 of the shoulder harness 109 can include a plate coupling mechanism 146, such as multiple hook-and-loop fasteners, to couple the magnetic plate 143 to the shoulder portion 106. While FIG. 3 does not show the magnetic plate 143, FIG. 3 illustrates where the magnetic plate 146 can be positioned when secured to the shoulder harness 100. For instance, the magnetic plate 146 can be positioned on top of the plate coupling mechanism 146.

The shoulder harness 100 can further include a padded member 149 that may be configured to cover the magnetic plate 143 and the plate coupling mechanism 146 that is attached to either the shoulder portion 106 or the chest portion 109 of the shoulder harness 100. In various embodiments, the shoulder harness 100 may have a first padded member 146*a* located at the shoulder portion 106 and a second padded member 146*b* located at the chest portion 109 of the chest strap 113. In other embodiments, additional layers of padding may be added or removed to the padded member 146 to increase or decrease the coupling force of the wrist attachment 112, as will be discussed, to the at least one coupling section 143. In various embodiments, the magnetic plate 143 and/or the magnet 125 may be at least partially made of a material suitable for magnetic coupling, such as stainless steel, iron, aluminum, other materials, and/or a combination thereof.

As noted above, in various embodiments, the shoulder harness 100 may include a single chest strap 140 that wraps around the front chest of the operator 10, under an opposite arm, around the back of the operator 10, and reattaches to the shoulder harness 100 using a suitable coupling mechanism. In other embodiments, the chest strap 140 may include multiple straps configured to wrap around the operator 10, such as the torso of the operator 10, and detachably attach to the shoulder harness 100 by any of a plurality of attaching mechanisms, including hook-and-loop fasteners, snap fasteners, side release buckles, other devices, and/or combinations thereof. To this end, the shoulder harness 100 may be worn on either the right or left shoulder of an operator 10 and the chest strap 140 can be wrapped around the torso of the operator 10 and, for instance, under the opposite arm.

The wrist attachment 112 may include an inner portion and an outer portion. The inner portion of the wrist attachment 112 may include a piece of fabric or other padded material configured to secure over the screw head 131, or other suitable connector, positioned on the inner side of the wrist strap 118. Furthermore, the inner material may partially provide padding for the wrist of the operator 10 from the screw head 131 or other connector. The inner portion of the wrist strap 118 may be made of any of a plurality of materials including, but not limited to, foam, felt, other fabric materials, and/or a combination thereof. The outer portion of the wrist strap 118 can include banded material that secures around the wrist of the operator 10. The outer portion may be made of any of a plurality of materials including moisture-wicking fabric or other materials. In various embodiments, the wrist attachment may secure around the wrist of an operator 10 by any of a plurality of connection mechanisms including but not limited to being partly made of an elastic material, a side release buckle, a snap fastener, hook and loop connector, other means, and a combination thereof.

Figure 5:
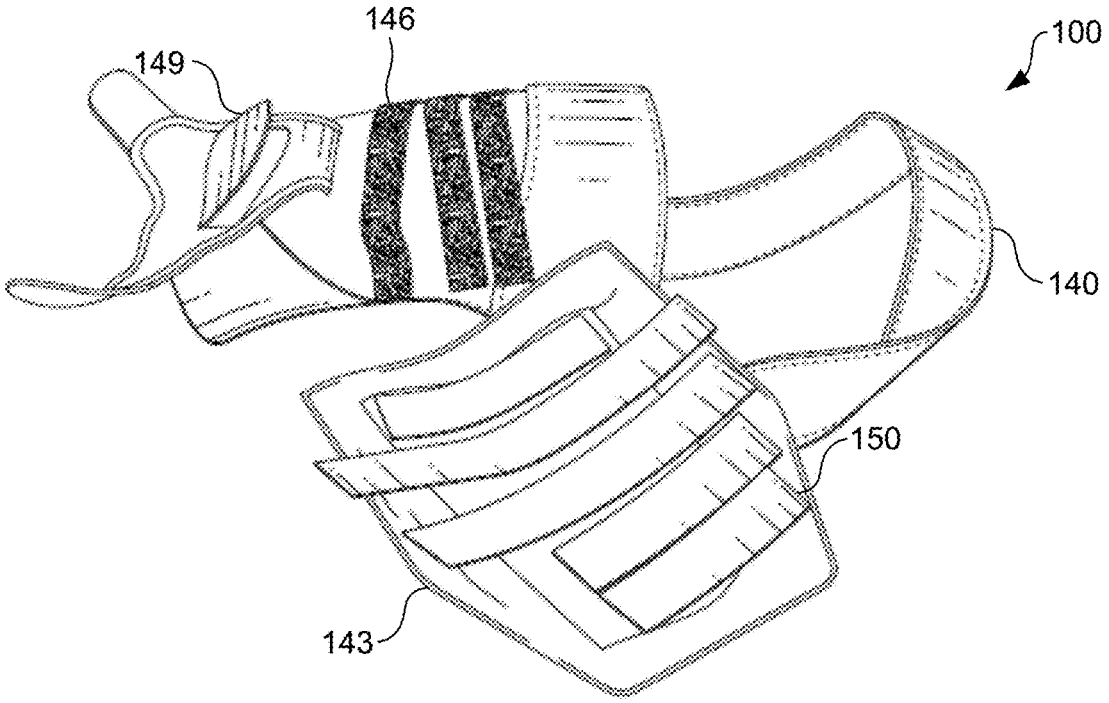
Figure 6:
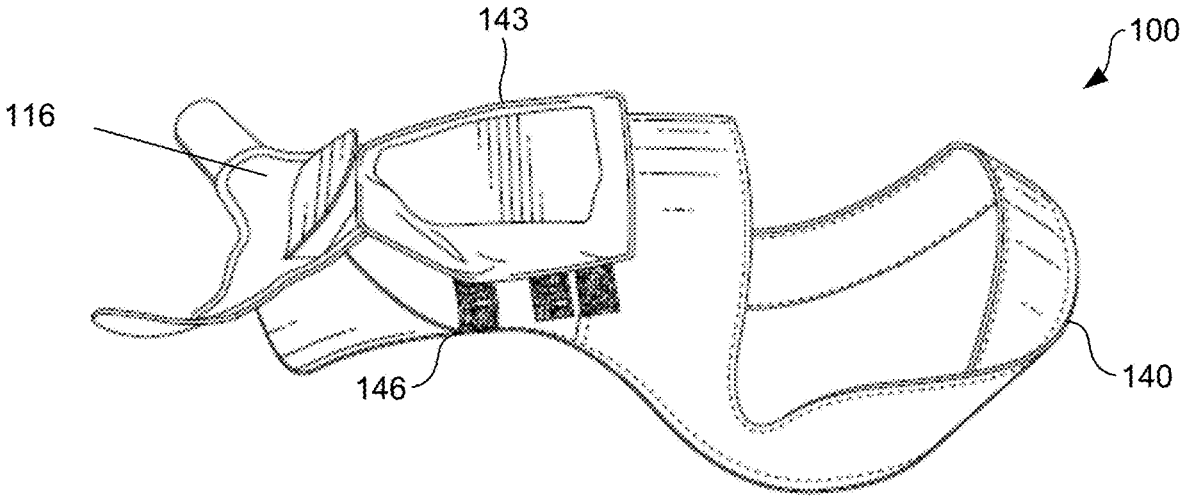

Turning now to FIG. 5, the magnetic plate 143 is shown having fasteners 150 (e.g., hook-and-loop fasteners) that engage with the plate coupling mechanism 146 to secure the magnetic plate 143 to the shoulder harness 100. FIG. 6 shows the magnetic plate 143 being positioned on the shoulder harness 100, such that the magnetic plate 143 can be used to form a magnetic coupling with the coupling member 115.

In various embodiments, the magnet 125 and/or the magnetic plate 143 can include a predetermined magnetic field strength. Referring back to FIG. 2, in various embodiments, the magnet 125 may be interchanged with other magnets of varying magnetic field strengths to adjust the force required to decouple the wrist attachment 112 from the shoulder harness 100 by the operator 10 while performing a swing action. In other embodiments, the coupling member 115 may be formed of a magnetic material such that the coupling member 115 itself has magnetic characteristics.

In some embodiments, the shoulder harness 100 may include a noise emitting device (not shown) that may be configured to emit a noise when a predetermined event occurs. In various embodiments, the noise emitting device may be a bell and clapper, wherein the clapper is a cylindrical member that surrounds the connector and slidably moves along the length of the connector to strike a bell that is located on the coupling member 115. Thus, the noise emitting device may emit a noise when the coupling member 115 decouples from the shoulder harness 100 by a force being exerted on the wrist attachment 112, thereby causing the clapper to strike the bell. As can be appreciated, a ringing of the bell or other noise emitted by the noise emitting device can instruct the operator 10 of the stage of the swing in which the coupling member 115 is released from the shoulder harness 100.

In other embodiments, the noise emitting device may include an electronic device comprising at least one electronic circuit (or computing device, such as a microcontroller) that comprises, or is otherwise coupled to, a speaker by any number of a plurality of communication mediums including a physical connection, BLUETOOTH®, WI-FI®, other communication mediums, or a combination thereof. In some embodiments, the shoulder harness 100 includes a sensor (e.g., radar, laser, resistance sensor, etc.) that detects when the coupling member 115 has decoupled from the shoulder harness and emits a noise via the speaker in response thereto.

Figure 7:
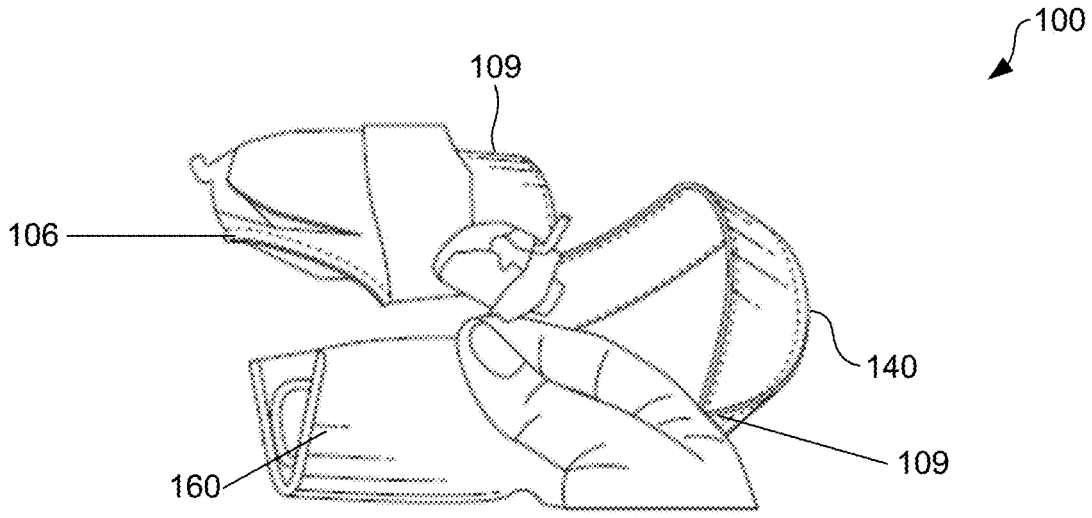
Figure 8:
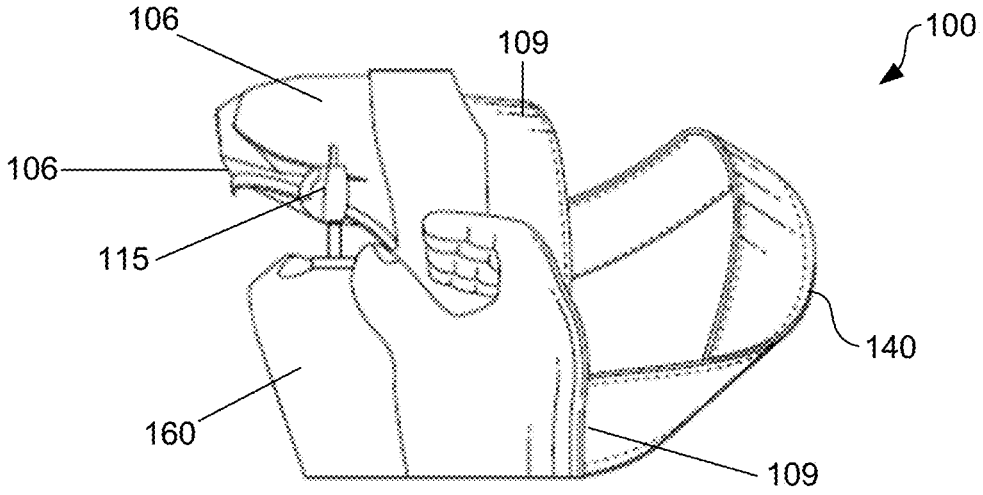

FIGS. 7-12 show various perspective views of the shoulder harness 100. More specifically, FIGS. 7 and 8 show an operator 10 attaching an auxiliary coupling section 160 to the chest portion 109 of the shoulder harness 100. In various embodiments, the auxiliary coupling section 160 may be attached to any location along the length of the chest strap 140 as the shoulder harness 100 may be worn on either the right or left shoulder of the operator 10. Consequently, the auxiliary coupling section 160 may need to be repositioned on the chest strap 140, for instance, depending on whether the shoulder harness 100 is worn on the left or right shoulder of the operator 10 so that the operator 10 may couple at least one wrist attachment 112 to the auxiliary coupling portion 160. Furthermore, the auxiliary coupling section 160 may be attached to the chest portion 109 by any of a plurality of attaching mechanisms, including hook and loop connectors, snap fasteners, side release buckles, other fasteners, other connectors, and/or combinations thereof.

Figure 9A:
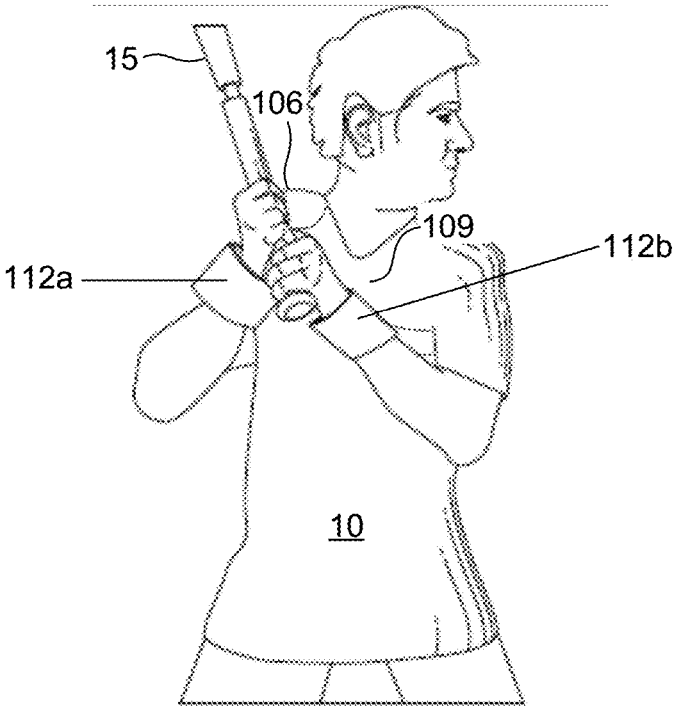
FIGS. 9A-9C illustrate various views of a swing cycle with an operator wearing the shoulder harness according to various embodiments of the present disclosure.
Figure 9B:
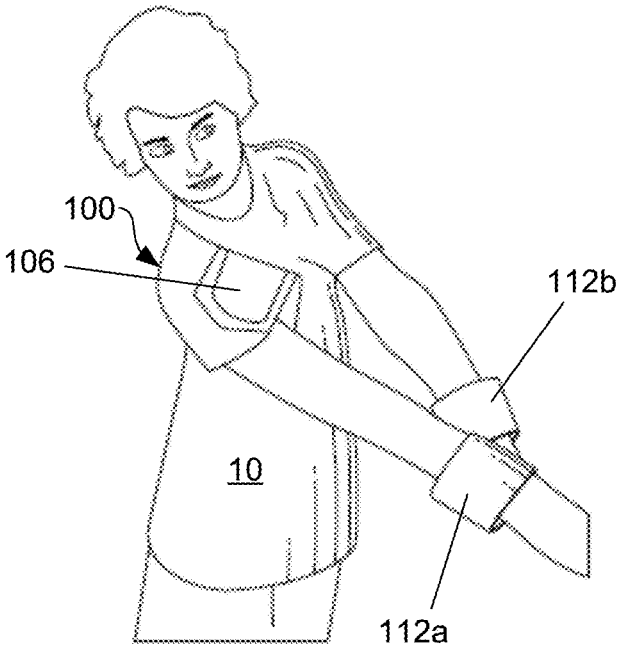
Figure 9C:
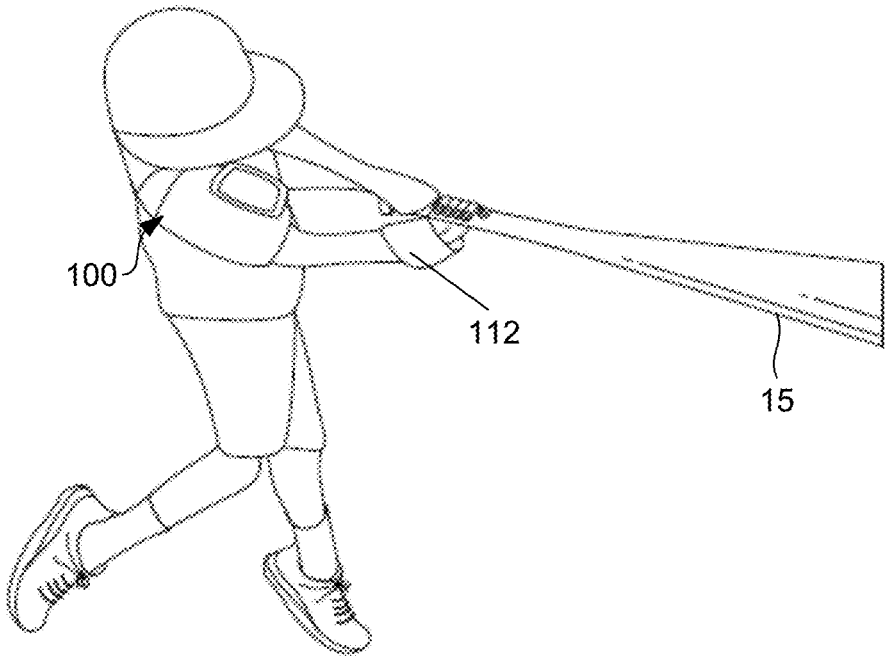

Now, operation of the shoulder harness 100 relative to an operator 10 (a person wearing the shoulder harness 100) is discussed. Referring to FIGS. 9A-9C, an operator 10 is shown in various stages of a swing sequence while wearing the shoulder harness 100. More specifically, FIG. 9A shows an operator 10 in the stance stage of the swing sequence while wearing the shoulder harness 100. Next, FIG. 9B shows the operator 10 in the swing acceleration stage of the swing sequence while wearing the shoulder harness 100. Notably, the coupling members 115 are sized and positioned to maintain an arm-to-chest position, or other similar relative positioning, in a stance stage and a swing acceleration stage until a predetermined amount of force is exerted during the swing or, in other words, in response to a predetermined stage of a swing being reached. FIG. 9C shows the operator 10 in the follow through stage of the swing sequence while wearing the shoulder harness 100.

In various embodiments, each of the first wrist attachment 112*a* and the second wrist attachment 112*b* are detachably attached to the shoulder portion 106 and the chest portion 109, respectively. When the operator 10 of a swinging device, such as a baseball bat, progresses through the stages of the swing, the first wrist attachment 112*a* and the second wrist attachment 112*b* are configured to break away from and detach from the shoulder portion 106 and the chest portion 109 of the shoulder harness 100.

Specifically, the first wrist attachment 112*a* and the second wrist attachment 112*b*, and the coupling member(s) 115 attached thereto, are configured to detach from the shoulder harness 100 at a predetermined point when the operator 10 exerts a predetermined amount of force upon the first wrist attachment 112*a* and the second wrist attachment 112*b* while the operator 10 progresses from the stance stage, through the coiling phase, and into the swing initiation phase and the arms of the operator accelerate from a predetermined position and into the swing acceleration stage of the swing.

Figure 10:
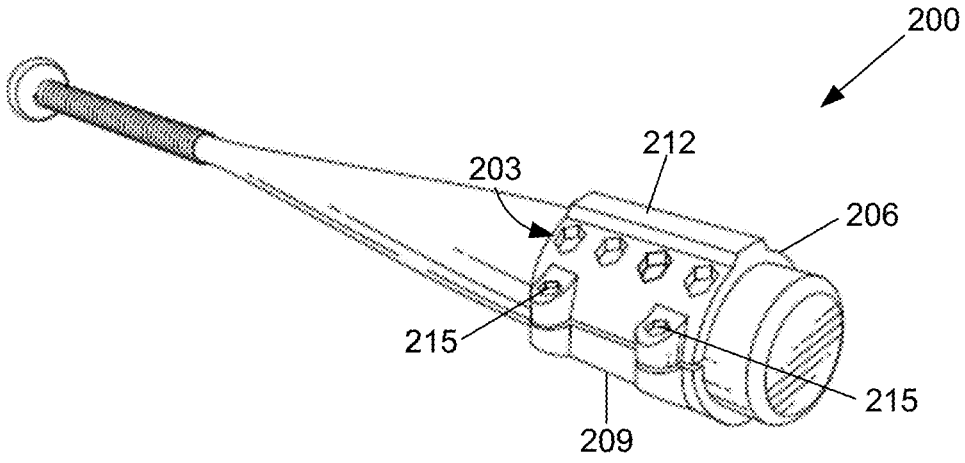
FIG. 10 illustrates a battle ax that may be used with or in place of the shoulder harness according to various embodiments of the present disclosure.

Referring to FIG. 10, a barrel ax 200 is shown in accordance with various embodiments of the disclosure, where the barrel ax 200 may be employed with or in place of the shoulder harness 100. The barrel ax 200 includes a cylindrical collar body 203 that may include a first portion 206 (e.g., a first half), a second portion 209 (e.g., a second half), and an elongated surface 212 projecting from the cylindrical collar body 203. In some embodiments, the barrel ax 200 includes a clamping portion 212 located on each longitudinal end of each of the first portion 206 and the second portion 209. The barrel ax 200 emulates a real axe, requiring the operator 10 to make contact with a narrow range of the projecting, elongated surface 212, the ideal location of the baseball bat or other swinging device.

As may be appreciated, and as shown in FIG. 10, the first portion 206 and the second portion 209 of the cylindrical collar body 203 may be configured to affix to and clamp around a swing device, such as a baseball bat, golf club, cricket bat, or other swinging device. In various embodiments, each of the first portion 206 and the second portion 209 may include a clamping portion 215, where the clamping portion 215 of the first portion 206 is configured to align with the clamping portion 215 of the second portion 209 to secure around the shaft of a swinging device.

In other embodiments the battle ax 200 may be configured to secure around the shaft of a swinging device by a plurality of clamping means including bolts, straps, connectors, other means, and/or a combination thereof. In various embodiments of the present disclosure, the inner surface of each of the first portion 206 and the inner surface of the second portion 209 may also include a padded material that consists of foam, silicon, felt, other materials, or combinations thereof that aid the battle ax 200 to grip the swinging device and to prevent the battle ax 200 from damaging the swinging device, further dampening impact with a baseball or other object. The elongated surface 212 projecting from the body of the barrel ax 200 is configured to provide an operator 10 with a visual indicator of the alignment of the swinging device throughout the swing device. Thus, giving visual feedback to the operator 10 of whether the operator 10 is making square contact with an object throughout the swing sequence.

In other embodiments, the barrel axe 200 may be a substantially flat raised segment that has fabric material on the ends configured to secure around the shaft of a swinging device. The substantially flat raised segment may be directly placed on a surface of a swinging device and attached to the swinging device by any of a plurality of means including hook and loop straps, side release buckles, snap fasteners, other means, and/or a combination thereof. The raised segment may perpendicularly extend from the surface of the swinging device and may be intended to contact an object. The raised segment may also provide an indication to an operator of when the swinging device is making "square" contact with an object during the swing sequence.

In further embodiments, the edge of the barrel ax 200 can include a noise emitting device that emits noise or performs a similar function. To this end, in some embodiments, the barrel axe 200 can include two plates separated by a spring or any other method to create a noise when a ball strikes the edge of the barrel ax 200.

Figure 11:
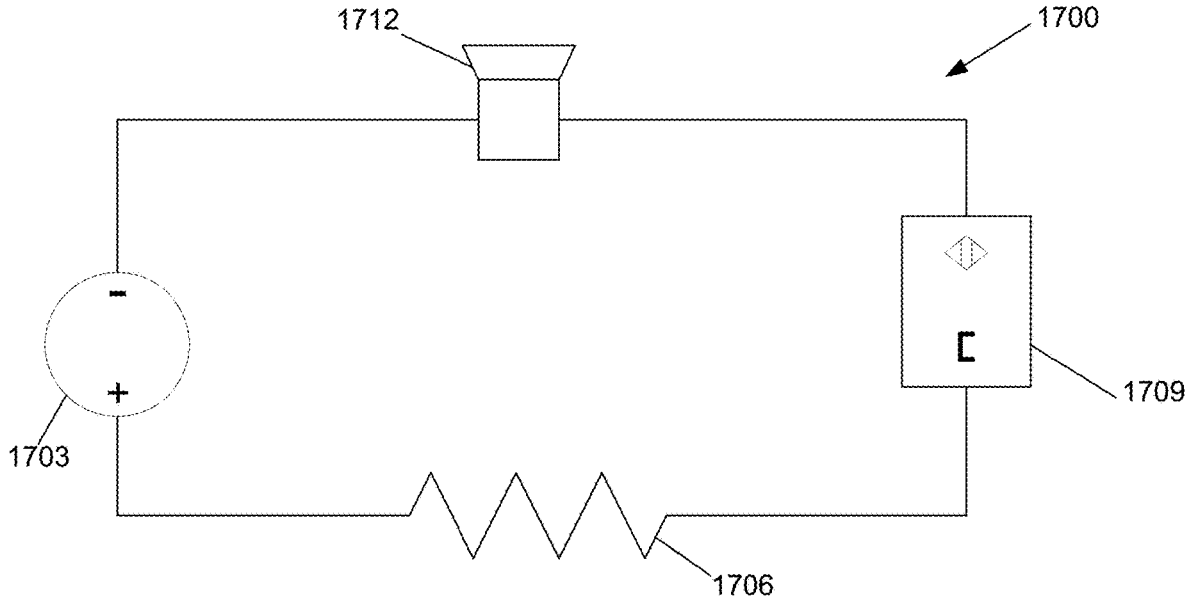
FIG. 11 is an example of a circuit for a noise emitting device that may be implemented in the shoulder harness according to various embodiments of the present disclosure.

Referring to FIG. 11, shown is an example of an electronic circuit 1700 that may be one possible embodiment of the noise emitting device 1115, 1123 for the at least one wrist attachment 1103. The electronic circuit may include at least a power source 1703, a resistor 1706, a sensor 1709, and a speaker 1712. The power source 1703 may be any of a plurality of power sources 1703 suitable for powering an electronic circuit including a battery. In various embodiments of the present disclosure, the sensor 1709 may be a magnetic sensor wherein the magnetic sensor detects when the wrist attachment 1103 decouples from either the first coupling section 203 or the second coupling section 206. Furthermore, in other embodiments, the electronic circuit 1700 may be capable of connecting to external speakers via any of a plurality of means to emit a noise to alert the operator of a predetermined event. The electronic circuit may connect to an external speaker through wired connection, Wi-Fi, Bluetooth, other means, and/or a combination thereof.

Figure 12A:
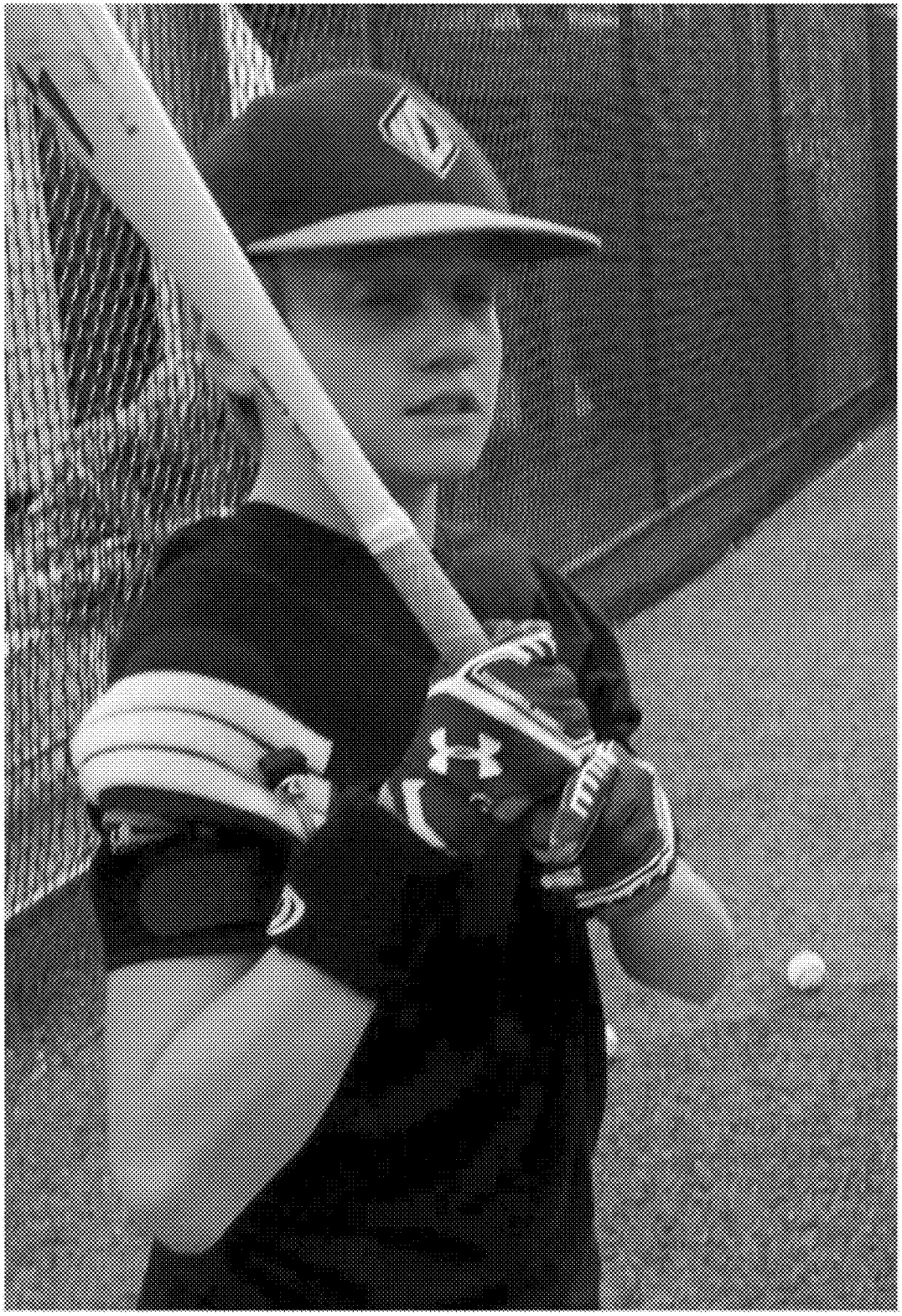
FIGS. 12A and 12B illustrate various views of a swing cycle with an operator wearing the shoulder harness according to various embodiments of the present disclosure.
Figure 12B:
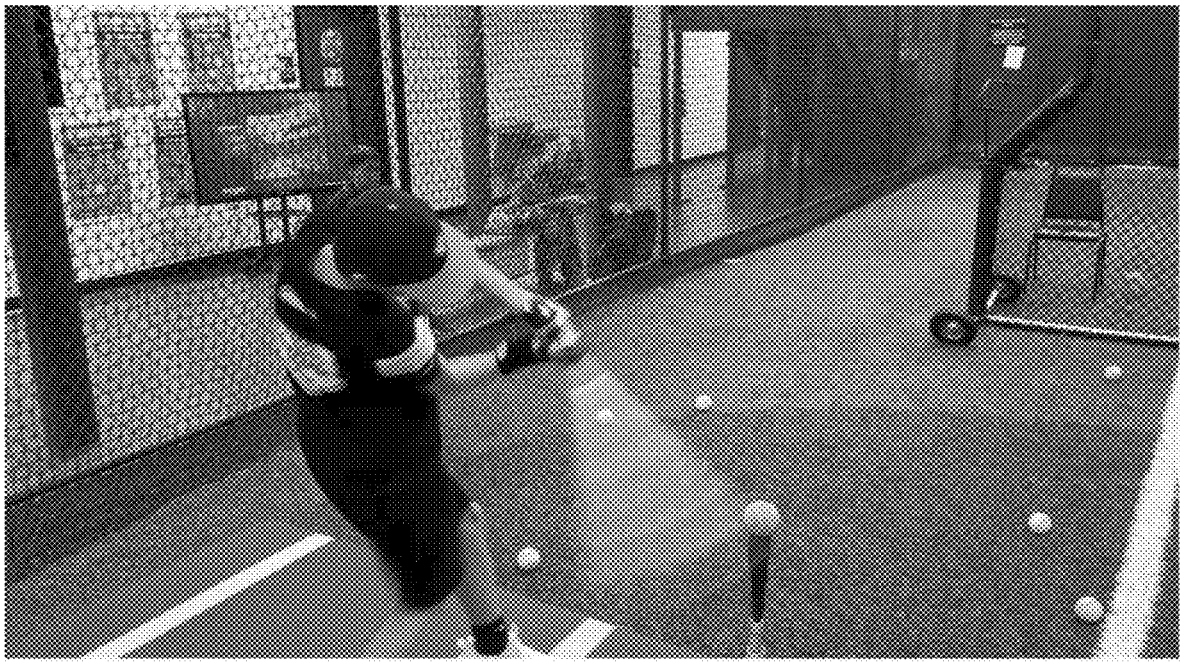

Referring to FIGS. 12A and 12B, an operator 10 is shown in various stages of a swing sequence while wearing the shoulder harness 100. Again, the coupling members 115 are sized and positioned to maintain an arm-to-chest position, or other similar relative positioning, in a stance stage and a swing acceleration stage until a predetermined amount of force is exerted during the swing or, in other words, in response to a predetermined stage of a swing being reached.

As can be appreciated, in embodiments in which hook-and-loop fasteners (e.g., VELCRO) are employed, when separated or ripped apart during a swing, a substantial noise is emitted, letting the operator 10 know of the separation. When the noise is heard, this can help the operator 10 realize when they are engaging the hands to the ball.

In embodiments in which magnets are employed, the operator 10 can hear the magnet click when they connect the coupling member 115 to the wrist attachment 112 and/or the shoulder portion 106 or chest portion 109. The fact that the operator 10 does not have to start with a connected apparatus is distinguishable from prior systems. Instead, the operator 10 can connect the hook-and-loop, magnetic, or other fasteners in the swing with ease. Further, if the operator 10 starts with his hands low or high they time the toe touch (which is the stride landing) with the magnet clicking the shoulder portion 106 or the chest portion 109 (e.g., in instances in which the shoulder portion 106 or the chest portion 106 include metal).

In some embodiments, the wrist attachment 112 has a base screw which connects to the desired region the operator 10 desires. The shoulder harness 100 places focus on the shoulder instead of the rotator cuff. Further, in some embodiments, the magnets can simply be changed with stronger pull force which will strengthen the whip action during a swing.

While many embodiments of the present disclosure relate to a swinging motion for baseball, the shoulder harness 100 is not limited to swinging activities or sports that require swinging motions. For instance, in some embodiments, the shoulder harness 100 can be employed to assist when arm-to-body positioning for throwing motions, such as pitching in baseball, cricket, and other sports require overhead throwing motions.

Notably, with respect to batting and swinging motions, the shoulder harness 100 can provide a short bat path, which teaches young and veteran players where to hold bat and trains muscle memory (muscle memory movements). The shoulder harness 100 provides players and coaches with an entire region on the outside portion of the shoulder to choose a comfortable position for each player's needs. For instance, players have different arm lengths and growth spurts that require adjustable hand positions for player comfort.

Figure 13:
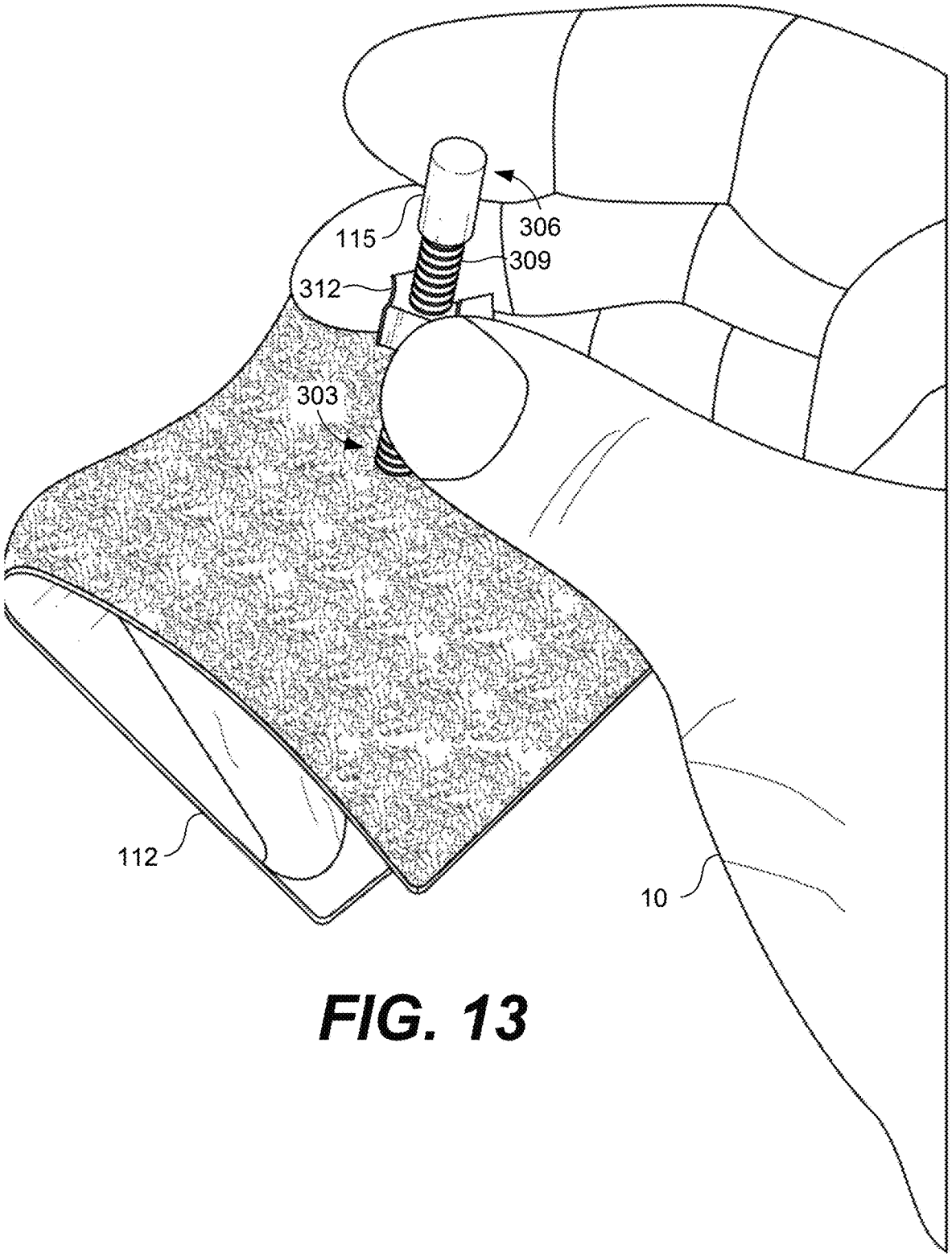
FIGS. 13 and 14 illustrate various enhanced views of a wrist band and a coupling member according to various embodiments of the present disclosure.

Turning now to FIGS. 12 and 13, enhanced views of a wrist attachment 112 and a coupling member 115 are shown. As noted above, the coupling member may include a first end 303 and a second end 306. The first end 303 of the coupling member 115 can be configured to be secured to the wrist attachment 112, and the second end 306 of the coupling member 115 can be configured to detachably attach to one of: the shoulder portion 106 or the chest portion 109. The coupling member 115 is configured to maintain a chest-to-arm position of the operator 10 and detach from one of the shoulder portion 106 or the chest portion 109 (and/or the wrist attachment 112) in response to a predefined amount of force being exerted by the operator 10 during a swing motion.

In some embodiments, the coupling member 115 can include a vertically-protruding body 309 having a head (not shown) positioned on an inside of the wrist attachment 112, where the vertically-protruding body projects out of a recess or other aperture in the wrist attachment 112. The head can have a body wider than the vertically-protruding body 309 (and wider than the aperture) to secure the coupling member 115, whereas a nut 312 or similar device can secure the coupling member 115 to the wrist attachment 112. As such, in some embodiments, the vertically-protruding body 309 includes a threaded vertically-protruding body on which a nut 312 can be threadably coupled.

Figure 14:
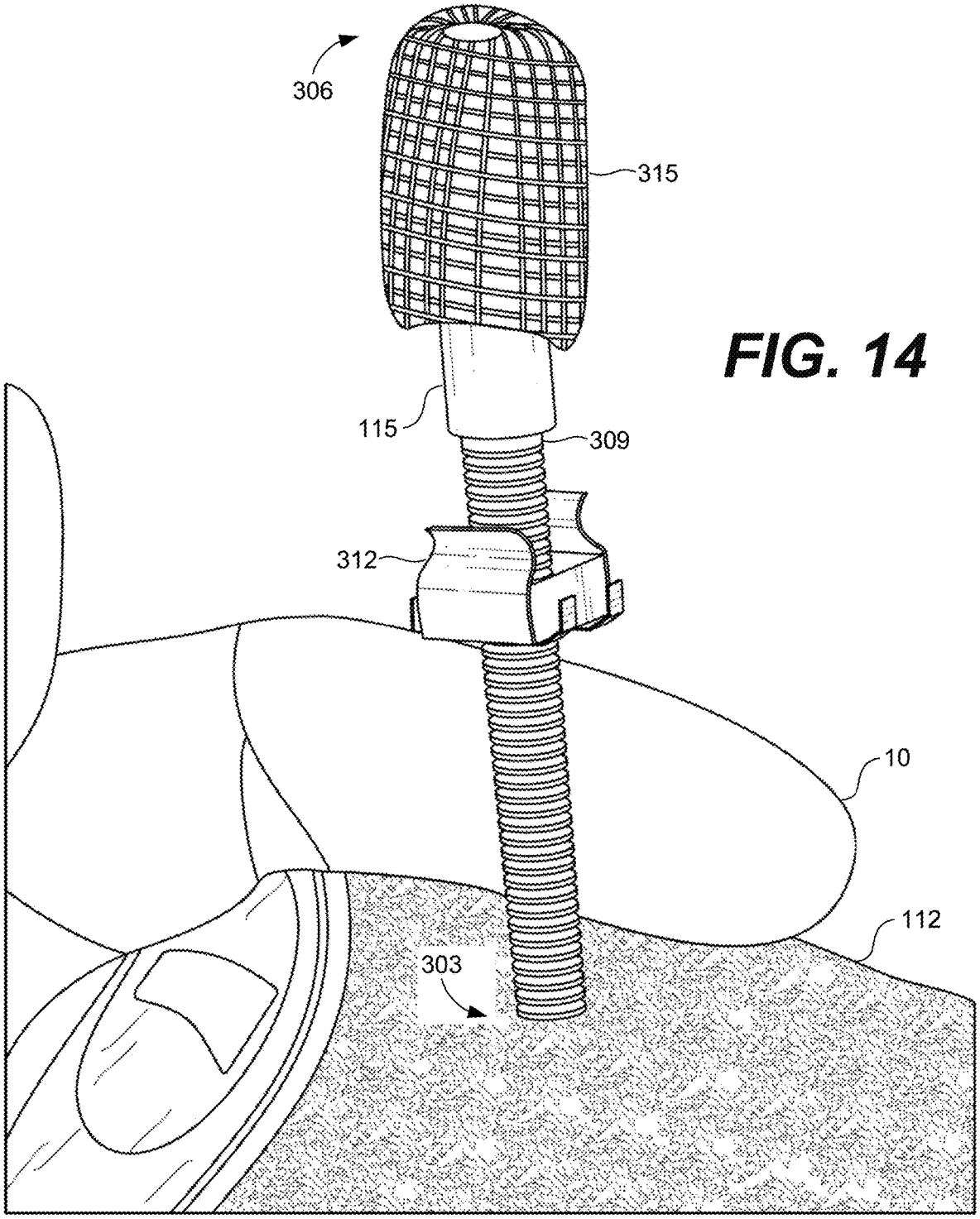

Specifically, FIG. 14 shows an attachment device 315 positioned on a distal end of the coupling member 115 (e.g., the second end 306). The attachment device 315 can include a magnet in some embodiments. However, in some embodiments, the attachment device 315 includes a hook-and-loop fastener, such as Velcro®.

As the hook-and-loop fasteners of the attachment device 315 is included therewith, players who disconnect their hands before the big muscles transfer energy, will be able to hear the mistake, thereby also making coaching more effective. The ripping noise should be heard near contact. Further, in embodiments, in which magnets are employed, a noise is made when connecting to a metal plate on the shoulder portion 106 or the chest portion 109. Advanced players can use this feature to use the noise for timing the "separation" and landing phase of swing. The magnets can be interchangeable with stronger magnets, creating stronger whip action resulting in exit velocity. This can also be considered a strength trainer for the square whip contact through ball. The wristbands will have interchangeable screws for players and coaches desired hand position in stance. Some players want their hands closer to body and some like more space. Some may want to experiment. With the spacing system, players can train to find the position that works for them best. As such, in some embodiments, the attachment device 315 can include any magnetic or non-magnetic device that emits a sound when attached or detached from the shoulder portion 106 or the chest portion 109.

It is understood that disjunctive language such as the phrase "at least one of X, Y, or Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

Although embodiments have been described herein in detail, the descriptions are by way of example. The features of the embodiments described herein are representative and, in alternative embodiments, certain features and elements can be added or omitted. Additionally, modifications to aspects of the embodiments described herein can be made by those skilled in the art without departing from the spirit and scope of the present invention defined in the following claims, the scope of which are to be accorded the broadest interpretation so as to encompass modifications and equivalent structures.

Therefore, the following is claimed:

1. A swing training device, comprising:

a shoulder harness, comprising:

a shoulder portion configured to be worn about a shoulder of an operator;

a chest portion configured to be worn about a chest of the operator;

a first wrist attachment configured to be worn on a first wrist of the operator;

a second wrist attachment configured to be worn on the second wrist of the operator:

a first coupling member, wherein a first end of the first coupling member is configured to be attached to first wrist attachment, and a second end of the first coupling member is configured to removably attach to the shoulder portion, the first coupling member being configured to detach from at least the shoulder portion during a swing motion:

a second coupling member, wherein a first end of the second coupling member is configured to be attached to the second wrist attachment, and a second end of the second coupling member is configured to removably attach to the chest portion, the second coupling member being configured to detach from at least the chest portion during the swing motion: and wherein the first coupling member and the second coupling member are configured to maintain a chest-to-arm position of the operator and detach from the shoulder portion and the chest portion, respectively, in response to a predefined amount of force being exerted by the operator during the swing motion.

2. The swing training device of claim 1, wherein:

the first end of the first coupling member is configured to be removably attached to the first wrist attachment; and the first end of the second coupling member is configured to be removably attached to the second wrist attachment.

3. The swing training device of claim 1, wherein the second end of the first coupling member comprises a first magnet configured to magnetically couple to the shoulder portion; and the second end of the second coupling member comprises a second magnet configured to magnetically couple to the chest portion.

4. The swing training device of claim 2, wherein:

the second end of the first coupling member comprises a first plurality of hook-and-loop fasteners configured to couple to the shoulder portion; and the second end of the second coupling member comprises a second plurality of hook-and-loop fasteners configured to couple to the chest portion.

5. The swing training device of claim 1, wherein the coupling member further comprises a noise emitting device configured to emit a noise when the at least one coupling member decouples from the shoulder portion or the chest portion.

6. The swing training device of claim 1, wherein:

the shoulder portion comprises a first padded member configured to be positioned on the shoulder of the operator; and the chest portion comprises a second padded member configured to be worn on the chest of the operator.

7. The swing training device of claim 1, wherein the at least one coupling member is at least one rigid cylindrical rod.

8. The swing training device of claim 1, wherein the swing training device further comprises:

a swinging device, and a collar configured to detachably attach to a shaft of the swinging device, the collar comprising a first portion detachably attached to a second portion, the collar further comprising an elongated substantially horizontal surface projecting from at least one of the first portion and the second portion, the elongated substantially horizontal surface being adapted to contact a ball.

9. The swing training device of claim 7, wherein the cylindrical collar is configured to secure to a shaft of one of: a baseball bat, a golf club, a tennis racket, and a cricket bat.

10. A method, comprising:

providing a swing training device that comprises:

a shoulder harness, comprising:

a shoulder portion configured to be worn about a shoulder of an operator:

a chest portion configured to be worn about a chest of the operator:

a first wrist attachment configured to be worn on a first wrist of the operator:

a second wrist attachment configured to be worn on the second wrist of the operator:

a first coupling member, wherein a first end of the first coupling member is configured to be attached to the first wrist attachment, and a second end of the first coupling member is configured to removably attach to the shoulder portion, the first coupling member being configured to detach from at least the shoulder portion during a swing motion:

a second coupling member, wherein a first end of the second coupling member is configured to be attached to the second wrist attachment, and a second end of the second coupling member is configured to removably attach to the chest portion, the second coupling member being configured to detach from at least the chest portion during the swing motion: and wherein the first coupling member and the second coupling member are configured to maintain a chest-to-arm position of the operator and detach from the shoulder portion and the chest portion, respectively, in response to a predefined amount of force being exerted by the operator during the swing motion;

positioning the swing training device on the operator; and performing, by the operator, a swing using the swing training device.

* * * * *